US009215544B2

(12) United States Patent
Faure et al.

(10) Patent No.: US 9,215,544 B2
(45) Date of Patent: Dec. 15, 2015

(54) OPTIMIZATION OF BINAURAL SOUND SPATIALIZATION BASED ON MULTICHANNEL ENCODING

(75) Inventors: Julien Faure, Lannion (FR); Jérôme Daniel, Penvenan (FR); Marc Emerit, Rennes (FR)

(73) Assignee: Orange, Paris (FR)

( * ) Notice: Subject to any disclaimer, the term of this patent is extended or adjusted under 35 U.S.C. 154(b) by 1266 days.

(21) Appl. No.: 12/224,840

(22) PCT Filed: Mar. 1, 2007

(86) PCT No.: PCT/FR2007/050867

§ 371 (c)(1),
(2), (4) Date: Sep. 8, 2008

(87) PCT Pub. No.: WO2007/101958

PCT Pub. Date: Sep. 13, 2007

(65) Prior Publication Data

US 2009/0067636 A1 Mar. 12, 2009

(30) Foreign Application Priority Data

Mar. 9, 2006 (FR) ..... 06 02098

(51) Int. Cl.
*H04R 5/00* (2006.01)
*H04S 1/00* (2006.01)
*H04S 5/00* (2006.01)

(52) U.S. Cl.
CPC . *H04S 1/00* (2013.01); *H04S 1/002* (2013.01); *H04S 5/00* (2013.01); *H04S 2420/01* (2013.01)

(58) Field of Classification Search
CPC ..... H04S 1/00; H04S 2420/01; H04S 1/002; H04S 5/00; H04S 1/005
USPC ..... 381/17, 18, 19, 23, 22, 21, 20
See application file for complete search history.

(56) References Cited

U.S. PATENT DOCUMENTS 5,500,900 A 3/1996 Chen et al.
5,596,644 A 1/1997 Abel et al.
5,727,066 A * 3/1998 Elliott et al. ..... 381/1
5,802,180 A * 9/1998 Abel et al. ..... 381/17

(Continued)

FOREIGN PATENT DOCUMENTS

WO WO 9000851 A1 * 1/1990
WO WO 00/19415 4/2000

*Primary Examiner* — Vivian Chin
*Assistant Examiner* — Con P Tran
(74) *Attorney, Agent, or Firm* — Knobbe Martens Olson & Bear LLP

(57) ABSTRACT

The invention concerns sound spatialization with multichannel encoding for binaural reproduction on two loudspeakers, the spatial encoding being defined by encoding functions associated with multiple encoding channels and the decoding by applying filters for binaural reproduction. The invention provides for an optimization as follows: a) obtaining a original set of acoustic transfer functions particular to an individual's morphology (HRIR;HRTF), b) selecting spatial encoding functions (g(θ,φ,n)) and/or decoding filters (F(t,n)), and c) through successive iterations, optimizing the filters associated with the selected encoding functions or the encoding functions associated with the selected filters, or jointly the selected filters and encoding functions, by minimizing an error (c(HRIR,HRIR*)) calculated based on a comparison between: the original set of transfer functions (HRIR), and a set of reconstructed transfer functions (HRIR*) from encoding functions and decoding filters, whether optimized and/or selected.

13 Claims, 5 Drawing Sheets

(56) References Cited

U.S. PATENT DOCUMENTS 5,862,227 A * 1/1999 Orduna-Bustamante et al. ..... 381/17
6,181,800 B1 1/2001 Lambrecht
7,231,054 B1 * 6/2007 Jot et al. ..... 381/310
2008/0137870 A1 * 6/2008 Nicol et al. ..... 381/17
2008/0306720 A1 * 12/2008 Nicol et al. ..... 703/13

* cited by examiner

FILT
T (Smp)
Amplitude (dB)
Phase (RAD)
Freq.
(deg)

OPTIMIZATION OF BINAURAL SOUND SPATIALIZATION BASED ON MULTICHANNEL ENCODING

This application is a national stage entry of International Application No. PCT/FR2007/050867, filed on Mar. 1, 2007, and claims priority to French Application No. 06 02098, filed Mar. 9, 2006, both of which are hereby incorporated by reference as if fully set forth herein in their entireties.

BACKGROUND OF THE INVENTION

The present invention is concerned with processing sound signals for their spatialization.

Spatialized sound reproduction allows a listener to perceive sound sources originating from any direction or position in space.

The particular spatialized techniques of sound reproduction to which the present invention pertains are based on the acoustic transfer functions for the head between the positions in space and the auditory canal. These transfer functions termed "HRTF" (for "Head Related Transfer Functions") relate to the frequency shape of the transfer functions. Their temporal shape will be denoted hereinafter by "HRIR" (for "Head Related Impulse Response").

Additionally, the term "binaural" is concerned with reproduction on a stereophonic headset, but with spatialization effects. The present invention is not limited to this technique and applies in particular also to techniques derived from binaural such as so-called "transaural" reproduction techniques, that is to say those on remote loudspeakers. Such techniques can then use what is called "crosstalk cancellation" which consists in canceling the acoustic cross-paths in such a way that a sound, thus processed then emitted by the loudspeakers, can be perceived only by one of a listener's two ears.

The term "multichannel", in processing for spatialized sound reproduction, consists in producing a representation of the acoustic field in the form of N signals (termed spatial components). These signals contain the whole set of sounds which make up the sound field, but with weightings which depend on their direction (or "incidence") and described by N associated spatial encoding functions. The reconstruction of the sound field, for reproduction at a chosen point, is then ensured by N' spatial decoding functions (usually with N=N').

In the particular case of binaural, this decomposition makes it possible to carry out so-called "multichannel binaural" encoding and decoding. The decoding functions (which in reality are filters), associated with a given suite of spatial encoding functions (which in reality are encoding gains), when they are optimum in reproduction, ensure a feeling of perfect immersion of the listener within a sound scene, whereas in reality he has, for binaural reproduction, only two loudspeakers (earpieces of a headset or remote loudspeakers).

The advantages of a multichannel approach for binaural techniques are manyfold since the encoding step is independent of the decoding step.

Thus, in the case of composition of a virtual sound scene on the basis of synthesized or recorded signals, the encoding is generally inexpensive in terms of memory and/or calculations since the spatial functions are gains which depend solely on the incidences of the sources to be encoded and not on the number of sources themselves. The cost of the decoding is also independent of the number of sources to be spatialized.

In the case furthermore of a real sound field measured by an array of microphones and encoded according to known spatial functions, it is nowadays possible to find decoding functions which allow satisfactory binaural listening.

Finally, the decoding functions can be individualized for each of the listeners.

The present invention is concerned in particular with improved obtainment of the decoding filters and/or of the encoding gains in the multichannel binaural technique. The context is as follows: sources are spatialized by multichannel encoding and the reproduction of the spatially encoded content is performed by applying appropriate decoding filters.

The reference WO-00/19415 discloses a multichannel binaural processing which provides for the calculation of decoding filters. Denoting by:

- $g_i(\theta_p,\phi_p)$ fixed spatial encoding functions where g is the gain corresponding to channel $i\in 1,\ldots,N$ and to position $p\in 1,\ldots,P$ defined by its angles of incidence θ (azimuth) and ϕ (elevation),
- $L(\theta_p,\phi_p,f)$ and $R(\theta_p,\phi_p,f)$ bases of HRTF functions obtained by measuring the acoustic transfer functions of each ear L and R of an individual for a number P of positions in space ($p\in 1,\ldots,P$) and for a given frequency f, this document WO-00/19415 essentially envisages two steps for obtaining filters on the basis of these spatial functions.

The delays are extracted from each HRTF. Specifically, the shape of a head is customarily such that, for a given position, a sound reaches one ear a certain time before reaching the other ear (a sound situated to the left reaching the left ear before reaching the right ear, of course). The difference in delay t between the two ears is an interaural index of location called the ITD (for "Interaural Time Difference"). New HRTF bases denoted $\underline{L}$ and $\underline{R}$ are then defined by:

$$L(\theta_p,\phi_p,f)=T_L(\theta_p,\phi_p)\underline{L}(\theta_p,\phi_p,f) \text{ for } p=1,2,\ldots,P$$

$$R(\theta_p,\phi_p,f)=T_R(\theta_p,\phi_p)\underline{L}(\theta_p,\phi_p,f) \text{ for } p=1,2,\ldots,P$$

where $T_{L,R}=e^{j2\pi ft_{L,R}}$, with a delay $t_{L,R}$

Decoding filters $L_i(f)$ and $R_i(f)$ for channel i which satisfy the equations:

$$L(\theta_p,\varphi_p,f)=\sum_{i=1,N} g_i(\theta_p,\varphi_p)L_i(f) \text{ for } p=1,2,\ldots,P$$

$$R(\theta_p,\varphi_p,f)=\sum_{i=1,N} g_i(\theta_p,\varphi_p)R_i(f) \text{ for } p=1,2,\ldots,P$$

are obtained in the second step, and these may also be written, in matrix notation, $\underline{L}=GL$ and $\underline{R}=GR$, G denoting a gain matrix.

To obtain these filters, this document proposes a procedure termed "calculation of the pseudo-inverse" which is concerned with satisfying the previous equations within the least squares sense, i.e.:

$$\underline{L}=GL\rightarrow L=(G^TG^{-1})G^T\underline{L}$$

The implementation of such a technique therefore requires the reintroduction of a delay corresponding to the ITD at the moment of encoding each sound source. Each source is therefore encoded twice (once for each ear). Document WO-00/19415 specifies that it is possible not to extract the delays but that the sound rendition quality would then be worse. In particular, the quality is better, even with fewer channels, if the delays are extracted.

Additionally, a second approach, proposed in document U.S. Pat. No. 5,500,900, for jointly calculating the decoding filters and the spatial encoding functions, consists in decomposing the HRIR suites by performing a principal component analysis (PCA) then by selecting a reduced number of components (which corresponds to the number of channels).

An equivalent approach, proposed in U.S. Pat. No. 5,596,644, uses a singular value decomposition (SVD) instead. If the delays are extracted from the HRIRs before decomposition and then used at the moment of encoding, reconstruction of the HRIRs is very good with a reduced number of components.

When the delays are left in the original filters, the number of channels must be increased so as to obtain good quality reconstruction.

Moreover, these prior art techniques do not make it possible to have universal spatial encoding functions. Specifically, the decomposition gives different spatial functions for each individual.

It is also indicated that multichannel binaural can also be viewed as the simulation in binaural of a multichannel rendition on a plurality of loudspeakers (more than two). One then speaks of the so-called "virtual loudspeaker" procedure when, nevertheless, binaural reproduction is effected, according to this approach, solely on two earpieces of a headset or on two remote loudspeakers. The principle of such reproduction consists in considering a configuration of loudspeakers distributed around the listener. During rendition on two real loudspeakers, intensity panning (or "pan pot") laws are then used to give the listener the sensation that sources are actually positioned in the space solely on the basis of two loudspeakers. One then speaks of "phantom sources". Similar rules are used to define positions of virtual loudspeakers, this amounting to defining spatial encoding functions. The decoding filters correspond directly to the HRIR functions calculated at the positions of the virtual loudspeakers.

For efficacious spatial rendition with a small number of channels, the prior art techniques require the extraction of the delays from the HRIRs. The techniques of sound pick-up or multichannel encoding at a point in space are widely used since it is then possible to subject the encoded signals to transformations (for example rotations). Now, in the case where the signal to be decoded is a multichannel signal measured (or encoded) at a point, the delay information is not extractible on the basis of the signal alone. The decoding filters must then make it possible to reproduce the delays for optimal sound rendition. Moreover, in the case of recordings, the number of channels may be small and the prior art techniques do not allow good decoding with few channels without extracting the delays. For example in the acquisition technique based on ambiophonic microphones, the multichannel signal acquired may be constituted by only four channels, typically. The expression "ambiophonic microphones" is understood to mean microphones composed of coincident directional sensors. The interaural delays must then be reproduced on decoding.

More generally, the extraction of the delays exhibits at least two other major drawbacks:

- the delays must be taken into account (addition of a step) at the moment of encoding, thereby increasing the necessary calculational resources,
- the delays being taken into account at the moment of encoding, the signals must be encoded for each ear and the number of filterings necessary for the decoding is doubled.

The present invention aims to improve the situation.

SUMMARY OF THE INVENTION

It proposes for this purpose a method of sound spatialization with multichannel encoding and for binaural reproduction on two loudspeakers, comprising a spatial encoding defined by encoding functions associated with a plurality of encoding channels and a decoding by applying filters for reproduction in a binaural context on the two loudspeakers.

The method within the sense of the invention comprises the steps:

a) obtaining an original suite of acoustic transfer functions specific to an individual's morphology (HRIR;HRTF), b) choosing spatial encoding functions and/or decoding filters, and c) through successive iterations, optimizing the filters associated with the chosen encoding functions or the encoding functions associated with the chosen filters, or jointly the chosen filters and encoding functions, by minimizing an error calculated as a function of a comparison between:

- the original suite of transfer functions, and
- a suite of transfer functions reconstructed on the basis of the encoding functions and the decoding filters, optimized and/or chosen.

What is meant by "acoustic transfer functions specific to an individual's morphology" can relate to the HRIR functions expressed in the time domain. However, the consideration, in the first step a), of the HRTF functions expressed in the frequency domain and, in reality, customarily corresponding to the Fourier transforms of the HRIR functions, is not excluded.

Thus, generally, the invention proposes the calculation by optimization of the filters associated with a set of chosen encoding gains or encoding gains associated with a set of chosen decoding filters, or joint optimization of the decoding filters and encoding gains. These filters and/or these gains have for example been fixed or calculated initially by the pseudo-inverse technique or virtual loudspeaker technique, described in particular in document WO-00/19415. Then, these filters and/or the associated gains are improved, within the sense of the invention, by iterative optimization which is concerned with reducing a predetermined error function.

The invention thus proposes the determination of decoding filters and encoding gains which allow at one and the same time good reconstruction of the delay and also good reconstruction of the amplitude of the HRTFs (modulus of the HRTFs), doing so for a small number of channels, as will be seen with reference to the description detailed hereinbelow.

Other characteristics and advantages of the invention will become apparent on examining the detailed description hereinafter, and the appended drawings in which:

DESCRIPTION OF PREFERRED EMBODIMENTS

In an exemplary embodiment, the method within the sense of the invention can be broken down into three steps:

a) obtaining an HRIR suite (left ear and/or right ear) at P positions around the listener, hereinafter denoted $H(\theta_p,\phi_p,t)$, b) fixing spatial encoding functions and/or base filters, the encoding functions being denoted $g(\theta_p,\phi_p,n)$ (or else $g(\theta,\phi,n,f)$), where:

$\theta$, $\phi$ are the angles of incidence in azimuth and elevation, n is the index of the encoding channel considered, and f is the frequency, c) and finding the filters associated with the fixed spatial functions or the spatial functions associated with the fixed filters or a combination of associated filters and spatial functions, by an optimization technique which will be described in detail further on.

It is simply indicated here that, for the implementation of the aforesaid first step a), the obtaining of the HRTFS of the second ear can be deduced from the measurement of the first ear by symmetry. The suite of HRIR functions can for example be measured on a subject by positioning microphones at the entrance of his auditory canal. As a variant, this HRIR suite can also be calculated by digital simulation procedures (modeling of the morphology of the subject or calculation by artificial neural net) or else have been subjected to a chosen processing (reduction of the number of samples, correction of the phase, or the like).

It is possible in this step a) to extract the delays from the HRIRS, to store them and then to add them at the moment of the spatial encoding, steps b) and c) remaining unchanged. This embodiment will be described in detail with reference in particular to FIG. 8.

Figure 1:
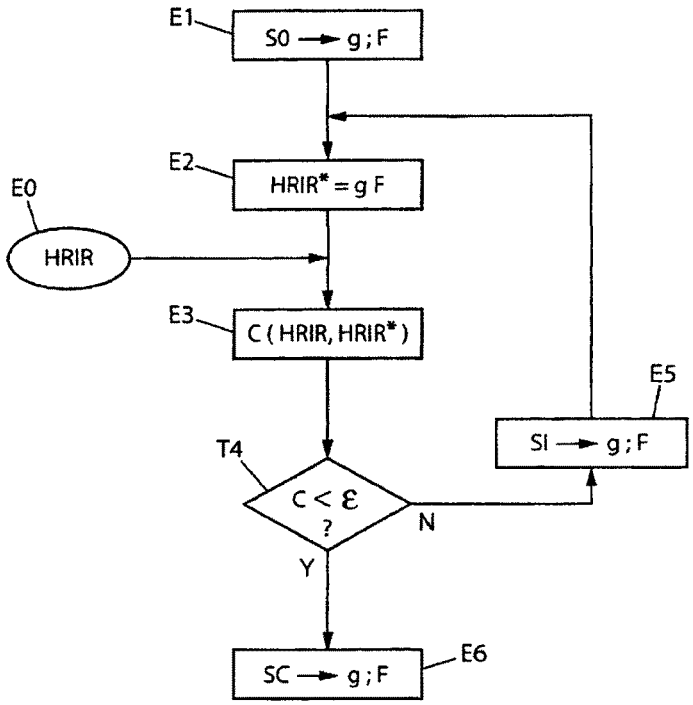
FIG. 1 illustrates the general steps of a method within the sense of the invention.

This first step a) bears the reference E0 in FIG. 1.

For the implementation of step b), if one seeks to obtain optimized filters on the one hand, it is necessary to fix the spatial encoding functions $g(\theta,\phi,n)$ (or $g(\theta,\phi,n,f)$) and, in order to obtain optimized spatial functions on the other hand, it is necessary to fix the decoding filters denoted $F(t,n)$.

Nevertheless, provision may be made to optimize jointly, at one and the same time the filters and the spatial functions, as indicated above.

The choice to optimize the spatial functions or to optimize the decoding filters may depend on various application contexts.

If the spatial encoding functions are fixed, they are then reproducible and universal and the individualization of the filters is effected simply on decoding.

Additionally, the spatial encoding functions, when they comprise a large number of zeros among n encoding channels as in the second embodiment described further on, make it possible to limit the number of operations during encoding. The intensity panning ("pan pot") laws between virtual loudspeakers in two dimensions and their extensions in three dimensions can be represented by encoding functions comprising only two nonzero gains, at most, for two dimensions and three nonzero gains for three dimensions, for a single given source. The number of nonzero gains is, of course, independent of the number of channels and, above all, the zero gains make it possible to lighten the encoding calculations.

As regards the encoding functions proper, several choices still present themselves.

The spatial functions of the spherical harmonic type in an ambiophonic context have mathematical qualities which make it possible to subject the encoded signals to transformations (for example rotations of the sound field). Moreover, such functions ensure compatibility between binaural decoding and ambiophonic recordings based on decomposing the sound field into spherical harmonics.

The encoding functions can be real or simulated directivity functions of microphones so as to make it possible to listen to recordings in multichannel binaural.

The encoding functions may be any (non-universal) and determined by any procedure, rendition then having to be optimized during subsequent steps of the method within the sense of the invention.

The spatial functions may equally well be time dependent or frequency dependent.

The optimization will then be effected taking account of this dependence (for example by independently optimizing each temporal or frequency sample).

As regards the decoding filters, the latter may be fixed in such a way that the decoding can be universal.

The decoding filters can be chosen also in such a way as to reduce the cost in resources involved in the filtering. For example, the use of so-called "infinite impulse response" or "IIR" filters is advantageous.

The decoding filters may also be chosen according to a psychoacoustic criterion, for example constructed on the basis of normalized Bark bands.

More generally, the decoding filters may be determined by an arbitrary procedure. Rendition, in particular for an individual listener, can then be optimized during subsequent steps of the method pertaining to the encoding functions.

This second step b) relating to the calculation of an initial solution S0 bears the reference E1 in FIG. 1. Briefly, it consists in choosing the decoding filters (referenced "F") and/or the spatial encoding functions (referenced "g") and determining an initial solution S0 for the encoding functions or the decoding filters, by a likewise chosen procedure.

For example, in the case where the fixed spatial functions are functions defining the intensity panning ("pan pot") laws between virtual loudspeakers, the filters of the starting solution S0 in step E1 may be directly the HRIR functions given at the corresponding positions of the virtual loudspeakers.

In this example, provision may also be made to jointly optimize the decoding filters and the encoding gains, the starting solution S0 again being determined by functions defining the intensity panning ("pan pot") laws as encoding functions and by the HRIR functions, themselves, given at the positions of the virtual loudspeakers, as decoding filters.

In another example where the spatial encoding functions are fixed as being spherical harmonics, the decoding filters are calculated in step E1 on the basis of the pseudo-inverse, so as to determine the starting solution S0.

More generally, the starting solution S0 in step E1 can be calculated on the basis of the least squares solution:

$$F = HRIR\, g^{-1}$$

It should be specified here that the elements F, HRIR and g are matrices. Furthermore, the notation $g^{-1}$ denotes the pseudo-inverse of the gain matrix g according to the expression:

$g^{-1} = \mathrm{pinv}(g) = g^T \cdot (g \cdot g^T)^{-1}$, the notation $g^T$ denoting the transpose of the matrix g.

Again generally, the starting solution S0 can be any (random or fixed), the essential thing being that it leads to a converged solution SC being obtained in step E6 of FIG. 1.

FIG. 1 also illustrates the operations E2, E3, T4, E5, E6 of the general step c), of optimization within the sense of the invention. Here, this optimization is conducted by iterations. By way of wholly non-limiting example, the so-called "gradient" optimization procedure (search for zeros of the first derivative of a multi-variable error function by finite differences) can be applied. Of course, variant procedures which make it possible to optimize functions according to an established criterion can also be considered.

In step E2, the reconstruction of the suite of HRIR functions then gives a reconstructed suite HRIR*=gF that differs from the original suite, at the first iteration.

In step E3, the calculation of an error function is an important point of the optimization procedure within the sense of the invention. A proposed error function consists in simply minimizing the difference of moduli between the Fourier transform HRTF* of the reconstructed suite of HRIR functions and the Fourier transform HRTF of the original suite of HRIR functions (given in step E0). This error function, denoted c, may be written:

$$c = \sum_p \sum_f \| F(HRIR) | - | F(HRIR^*) \|^2 \quad i.e. \quad c = \sum_p \sum_f \| HRTF(p, f) | - | HRTF^*(p, f) \|^2,$$

where F(X) denotes the Fourier transform of the function X.

Other error functions also allow optimal spatial rendition. For example, it is possible to weight the HRIR functions by a gain which depends on the position of the HRIR functions so as to better reconstruct certain favored positions in space, which may be written:

$$c = \sum_p \sum_f \| F(HRIR)|^2 - | F(HRIR^*)|^2 |^2 \text{ or } c = \sum_p \sum_f \| HRTF(p, f)|^2 - | HRTF^*(p, f)|^2 |^2$$

where $w_p$ is the gain corresponding to a position p. It is thus possible to favor the reconstruction of certain spatial zones of the HRIR function (for example the frontal part).

In the same manner, it is also possible to weight the HRIR functions as a function of time or frequency.

The error function can also minimize the energy difference between the moduli, i.e.:

$$c = \sum_p w_p \sum_f \| F(HRIR)| - | F(HRIR^*)\|^2 \text{ or } c = \sum_p w_p \sum_f \| HRTF(p, f)| - | HRTF^*(p, f)\|^2,$$

Generally, it will be assumed that any error function calculated entirely or in part on the basis of the HRIR functions can be provided (modulus, phase, estimated delay or ITD, interaural differences, or the like).

Additionally, if the error criterion pertains to the frequency samples of the HRTF functions, independently of one another, unlike what was proposed above (sum over all the frequencies for the calculation of the error function c), the optimization iterations can be applied successively to each frequency sample, with the advantage of then reducing the number of simultaneous variables, of having an error function specific to each frequency f and of encountering a stopping criterion as a function of convergence specific to each frequency.

Step T4 is a test to stop or not stop the iteration of the optimization as a function of a chosen stopping criterion. It may involve a criterion characterizing the fact that:

- the variable c has attained a minimum value $\epsilon$, and/or that
- the variable c is no longer decreasing sufficiently, and/or that
- a maximum number of iterations is attained, and/or that
- the modifications of the filters are no longer sufficient, or the like.

If the criterion is attained (arrow Y on exit from the test T4), the filters F(n,t) or the gains g(θ,ϕ,n) or the filter/gain pairs calculated make it possible to obtain optimal spatial rendition, as will be seen in particular with reference to FIG. 4C or FIG. 6 hereinafter. The processing then stops through the obtaining of a converged solution (step E6).

If the criterion is not attained (arrow N on exit from the test T4), according to the error function used, it is difficult to ascertain analytically what the evolution of the filters F or of the gains g should be in order to minimize the error c. Recourse is advantageously had to a gradient calculation to adjust the filters and/or the gains so that they lead to a reduction in the error function c (iterative steps E5).

This processing is advantageously computationally assisted. A function dubbed "fminunc" from the "optimization Toolbox" module of the Matlab® software, programmed in an appropriate manner, makes it possible to carry out steps E2, E3, T4, E5, E6 described above with reference to FIG. 1.

Of course, this embodiment illustrated in FIG. 1 applies equally well when it has been chosen to fix in step E1 the decoding filters, then to optimize the spatial encoding functions during steps E2, E3, E5, E6. It also applies when it has been chosen to iteratively optimize at one and the same time the encoding functions and the decoding filters.

FIRST EMBODIMENT

Described hereinafter is an exemplary optimization of the filters for decoding a content arising from a spatial encoding by spherical harmonic functions in an ambiophonic context of high order (or "high order ambisonic"), for reproduction to binaural. This is a sensitive case since if sources have been recorded or encoded in an ambiophonic context, the interaural delays must being complied with in the processing when decoding, by applying the decoding filters.

In the implementation of the invention set forth hereinafter by way of example, we have chosen to limit ourselves to the case of two dimensions and thus seek to provide optimized filters so as to decode an ambiophonic content to order 2 (five ambiophonic channels) for binaural listening on a headset with earpieces.

Figure 2:
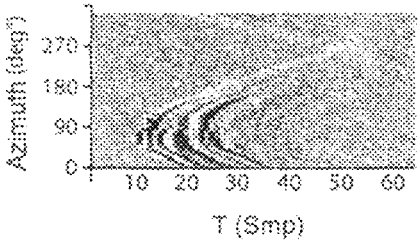
FIG. 2 illustrates the amplitude (gray levels) of the HRIR temporal functions (over several successive samples Smp) which have been chosen for the implementation of step E0 of FIG. 1, as a function of azimuth (in degrees denoted deg°)

For the embodiment of the first step a) of the general method described above (reference E0 of FIG. 1), use is made of a suite of HRIR functions measured for the left ear in a deadened chamber and for 64 different values of azimuth angle ranging from 0 to about 350° (ordinates of the graph of FIG. 2). The filters of this suite of HRIR functions have been reduced to 32 nonzero temporal samples (abscissae of the graph of FIG. 2).

A symmetry of the listener's head is assumed and the HRIRs of the right ear are symmetric to the HRIRs of the left ear.

As a variant of measurements to be performed on an individual, it is possible to obtain the HRIR functions from standard databases ("Kemar head") or by modeling the morphology of the individual, or the like.

Figure 3:
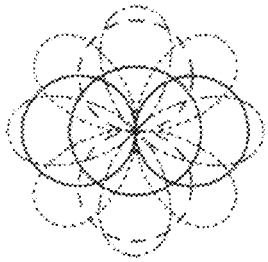
FIG. 3 illustrates the shape of a few first spherical harmonics in an ambiophonic context, as spatial encoding functions in a first embodiment, FIGS. 4A, 4B, 4C compare the performance of the processing according to the first embodiment, for a non-optimized solution (FIG. 4A), for a solution partially optimized by a few processing iterations (FIG. 4B) and for a solution completely optimized by the processing within the sense of the invention (FIG. 4C)

The spatial encoding functions chosen here are the spherical harmonics calculated on the basis of the functions cos (mθ) and sin(mθ), with increasing angular frequencies m=0, 1, 2, . . . , N to characterize the azimuthal dependence (as illustrated in FIG. 3), and on the basis of the Legendre functions for the elevational dependence, for a 3D encoding.

The starting solution S0 for step E1 is given by calculating the pseudo-inverse (with linear resolution). This starting solution constitutes the decoding solution which was proposed as such in document WO-00/19415 of the prior art described above. The optimization technique employed within the sense of the invention is preferably the gradient technique described above. The error function c employed corresponds to the least squares on the modulus of the Fourier transform of the HRIR functions, i.e.:

$$c = \sum_{p} \sum_{f} \| HRTF(p, f)| - |HRTF^{*}(p, f)\|^{2}$$

Figures 4A, 4B, 4C:
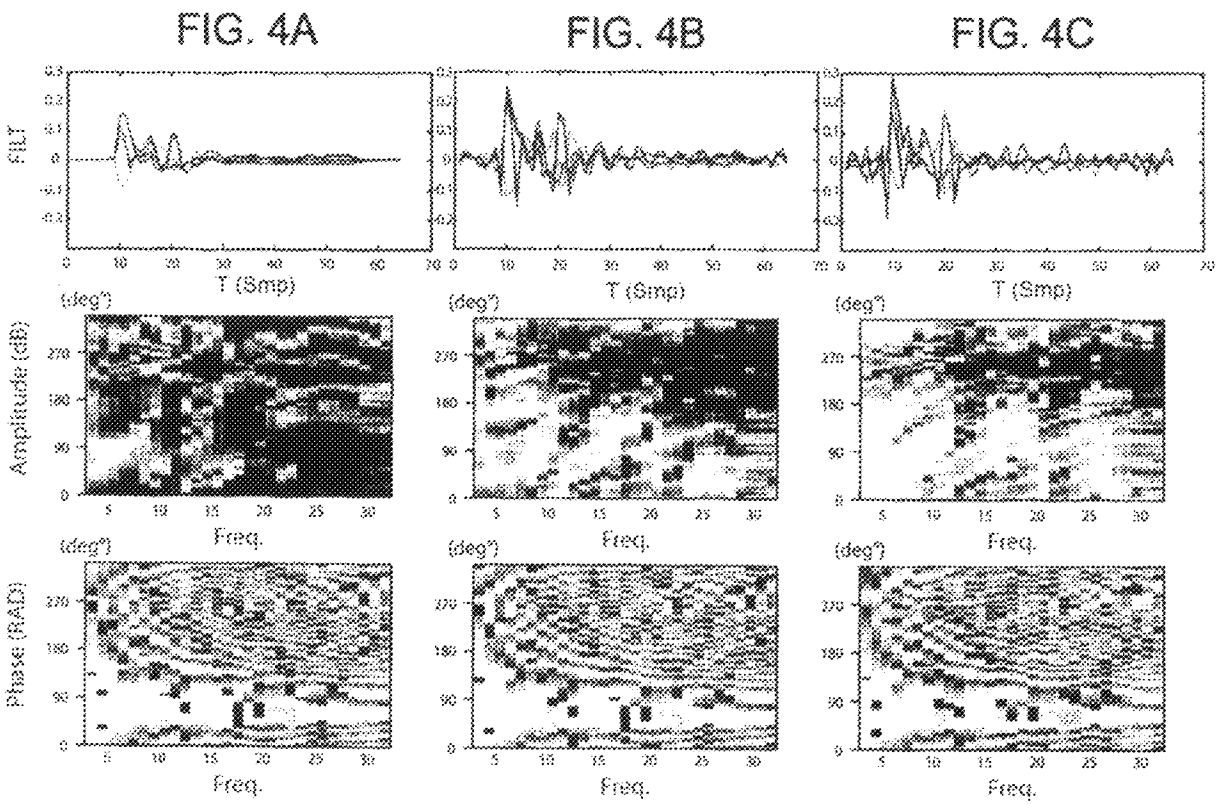

FIGS. 4A, 4B, 4C show the temporal shape (over a few tens of temporal samples) of the five decoding filters and the errors in reconstructing the modulus (in dB, illustrated by gray levels) and the phase (in radians, illustrated by gray levels) of the Fourier transform of the HRIR functions for each position (ordinates labeled by azimuth) and for each frequency (abscissae labeled by frequencies), respectively:

- on completion of the first step E1 (starting solution S0 obtained by linear resolution by calculating the pseudo-inverse),
- after a few iterations E5 (intermediate solution SI),
- on completion of the last processing step E6 (converged solution SC).

For the starting solution which nevertheless constituted the decoding solution within the sense of document WO-00/19415, the modulus of the HRTF functions is relatively poorly reconstructed, most of the reconstruction errors being greater than 8 dB.

Nevertheless, it is apparent that the error in the phase is practically unmodified in the course of the iterations. This error is however minimal at low frequencies and on the ispilateral part of the HRTF functions (region at 0-180° of azimuth). On the other hand, the error in the modulus decreases greatly as the optimization iterations proceed, especially in this ispilateral region. The optimization within the sense of the invention therefore makes it possible to improve the modulus of the HRTF functions without modifying the phase, therefore the group delay, and, thereby and especially, the interaural ITD delay, so that the rendition is particularly faithful by virtue of the implementation of this first embodiment.

SECOND EMBODIMENT

Described hereinafter is an exemplary optimization of the decoding filters for spatial functions arising from intensity panning ("pan pot") laws consisting, in simple terms, of mixing rules.

Panning laws are commonly employed by sound technicians to produce audio contents, in particular multichannel contents in so-called "surround" formats which are used in sound reproduction 5.1, 6.1, or the like. In this second embodiment, one seeks to calculate the filters which make it possible to reproduce a "surround" content on a headset. In this case, the encoding by panning laws is carried out by mixing a sound environment according to a "surround" format (tracks 5.1 of a digital recording for example). The filters optimized on the basis of the same panning laws then make it possible to obtain optimal binaural decoding for the desired rendition with this "surround" effect.

The present invention advantageously applies in the case where the positions of the virtual loudspeakers correspond to positions of a mass-market multichannel reproduction system, with "surround" effect. The optimized decoding filters then allow decoding of mass-market multimedia contents (typically multichannel contents with "surround" effect) for reproduction on two loudspeakers, for example on a binaural headset. This binaural reproduction of a content which is for example initially in the 5.1 format is optimized by virtue of the implementation of the invention.

The case of an example of ten virtual loudspeakers "disposed" around the listener is described hereinafter.

First of all, the HRIR functions are obtained at 64 positions around the listener, as described with reference to the first embodiment above.

The spatial functions given by the intensity panning laws (here tangent-wise) between each pair of adjacent loudspeakers, is determined in this second embodiment by a relation of the type:

$$\tan(\theta_v)=((L-R)/(L+R))\tan(u), \text{ where:}$$

Figure 5:
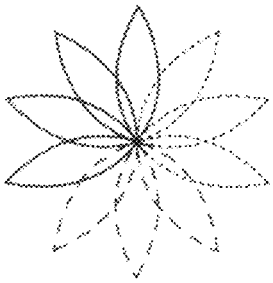
FIG. 5 illustrates the encoding functions in the virtual loudspeaker technique used in a second embodiment, FIG. 6 compares a real mean HRTF function (represented solid) with the mean HRTF functions reconstructed using the pseudo-inverse solution within the sense of the prior art (represented dotted), the starting solution given by the virtual loudspeaker procedure (represented as long dashes) and the convergent optimized solution, within the sense of the second embodiment of the invention (represented chain-dotted), FIG. 7 compares the variations of the original interaural ITD delay (solid line) with that obtained by the optimized solution within the sense of the second embodiment of the invention (chain-dotted), with that reconstructed on the basis of the virtual loudspeaker technique (long dashes) and with that reconstructed on the basis of the filters obtained by the pseudo-inverse solution within the sense of the prior art (dotted), FIG. 8 schematically represents a spatialization system that may be obtained by implementing the first embodiment, taking account of the interaural delays on encoding, FIG. 9 schematically represents a spatialization system that may be obtained by implementing the second embodiment, without taking account of the interaural delays on encoding but including these delays in the decoding filters.

- L is the gain of the left loudspeaker,
- R is the gain of the right loudspeaker,
- u is the angle between the loudspeakers (360/10=36° in this example, as illustrated in FIG. 5),
- $\theta_v$ is the angle for which one wishes to calculate the gains (typically the angle between the plane of symmetry of the two loudspeakers and the desired direction).

The forms of the ten spatial functions adopted as a function of azimuth are given in FIG. 5. For each azimuth, only two gains, at the maximum, to be associated with the encoding channels are nonzero. Specifically, it is considered here that a virtual loudspeaker is "placed" in such a way that one gain (if it is disposed on an encoding axis) or two gains (if it is disposed between two encoding axes), only, have to be determined to define the encoding. On the other hand, it is indicated that no encoding gain is zero a priori in an ambiophonic context whose encoding functions are illustrated in FIG. 3 described above. Nevertheless, the reproduction quality with a choice of ambiophonic encoding, after optimization within the sense of the first embodiment, is generally very good.

The optimization procedure used in the second embodiment is again the gradient procedure. The starting solution S0 in step E1 is given by the ten decoding filters which correspond to the ten HRIR functions given at the positions of the virtual loudspeakers. The fixed spatial functions are the encoding functions representing the panning laws. The error function c is based on the modulus of the Fourier transform of the HRIR functions, i.e.:

$$c = \sum_p \sum_f \| HRTF(p, f)| - |HRTF^*(p, f)\|^2$$

Figure 6:
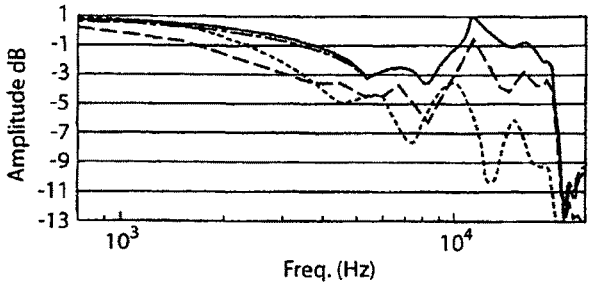

Reference is now made to FIG. 6, which compares a real HRTF function (represented solid), averaged over a set of 64 measured positions (for angles of azimuth ranging from 0 to about 350°), with the reconstructed mean HRTF functions by using:

- the pseudo-inverse starting solution, without optimization (represented dotted),
- the starting solution given by the more suitable virtual loudspeaker procedure (represented as long dashes),
- and the convergent optimized solution after a few iterations, within the sense of the invention (represented chain-dotted).

The optimized solution within the sense of the invention agrees perfectly with the original function, this being explained by the fact that the error function c proposed here is concerned with reducing to the maximum the error in the modulus of the function.

Figure 7:
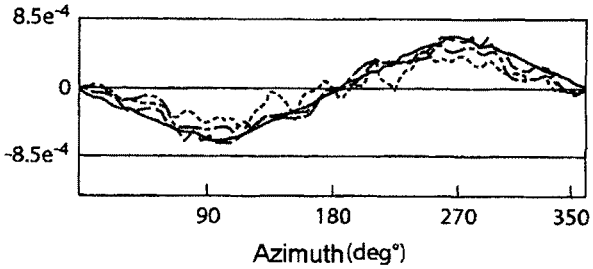

FIG. 7 illustrates the variations of the interaural ITD delay as a function of the azimuthal position of the HRIR functions. The optimized solution makes it possible to reconstruct an ITD delay (chain-dotted) that is relatively close to the original ITD (solid line), but equally as close nevertheless as that reconstructed on the basis of the starting solution, here obtained by the virtual loudspeaker technique (long dashes). The ITD delay reconstructed on the basis of the filters obtained by linear resolution (pseudo-inverse), represented dotted in FIG. 7, is fairly irregular and distant from the original ITD. These results clearly confirm the weak performance of the linear resolution procedure when the delays are reconstructed on the basis of the decoding filters.

The optimization of the method within the sense of the invention therefore makes it possible to reconstruct at one and the same time the modulus of the HRTF functions and the ITD group delay between the two ears.

Moreover, it is apparent in this second embodiment that the quality of the reconstructed filters is not affected by the choice of the encoding functions. Therefore, it is possible to use any spatial encoding functions, for example advantageously comprising many zeros, as in this exemplary embodiment, thereby making it possible to correspondingly reduce the resources necessary for calculating the encoding.

EXAMPLES OF IMPLEMENTATION

The object of this part of the description is to assess the gain in terms of number of operations and memory resources necessary for the implementation of the encoding and the multichannel binaural decoding within the sense of the invention, with decoding filters which take the delay into account.

The case dealt with in the example described here is that of two spatially distinct sources to be encoded in multichannel and to be reproduced in binaural. The two implementation examples of FIGS. 8 and 9 use the symmetry properties of the HRIR functions.

Figure 8:
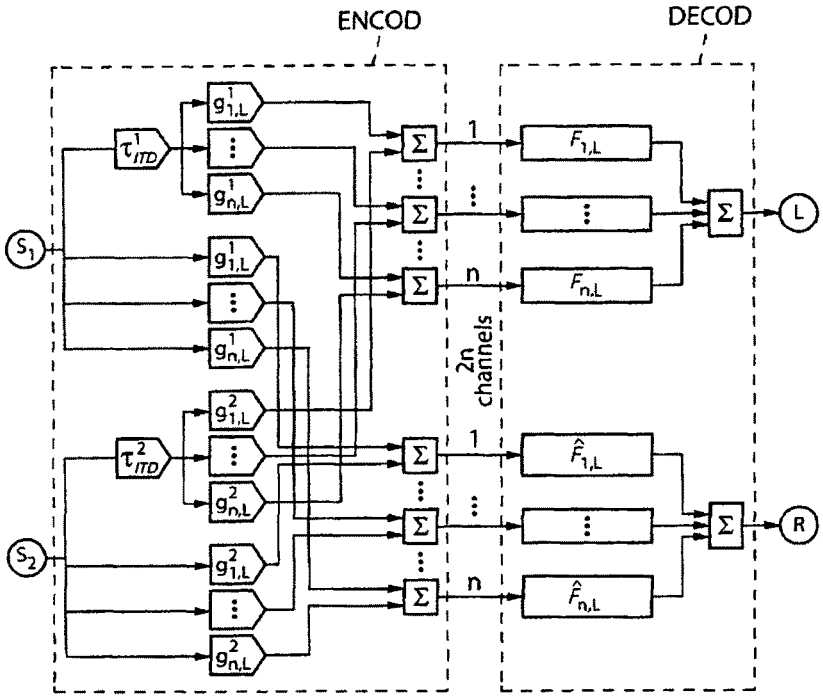
Figure 9:
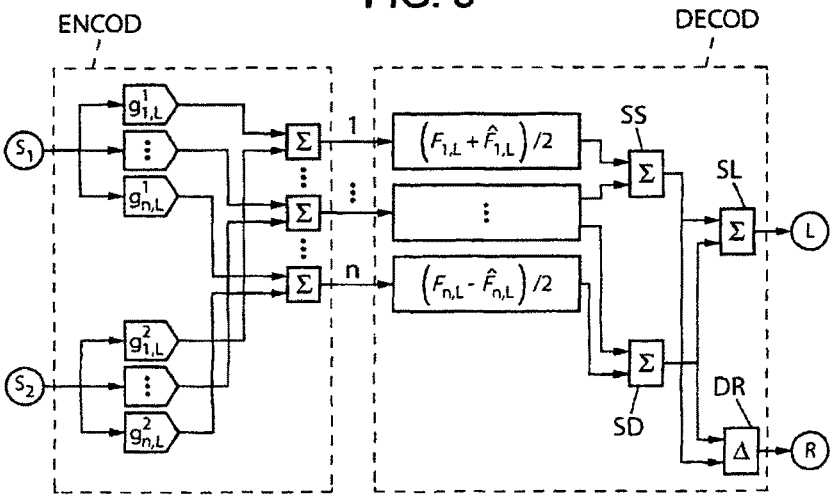

The example given in FIG. 9 corresponds to the case where the encoding gains are obtained by applying the virtual loudspeaker procedure according to the second embodiment described above. FIG. 8 presents an implementation of the encoding and of the multichannel decoding when the delays are not included in the decoding filters but must be taken into account right from the encoding. It may correspond to that of the prior art described above WO-00/19415, if indeed the decoding filters (and/or the encoding functions) have not been optimized within the sense of the invention.

The realization of FIG. 8 consists, in generic terms, in extracting, from the transfer functions obtained in step a), interaural delay information, while the optimization, within the sense of the invention, of the encoding functions and/or decoding filters is conducted here on the basis of the transfer functions from which this delay information has been extracted. Thereafter, these interaural delays can be stored then subsequently applied, in particular on encoding.

In the example of FIG. 8, the symmetry of the HRTF functions for the right ear and the left ear makes it possible to consider n filters $F_{j,L}$ and n symmetric filters $\hat{F}_{j,L}$, hence 2 n channels. The encoding gains are denoted $g^i_{j,L}$ (the gains of index R not having to be taken into account because of symmetry), where i ranges from 1 to K for K sources to be considered (in the example K=2) and j ranges from 1 to n for n filters $F_{j,L}$.

In FIGS. 8 and 9 the same notation $S_1$ and $S_2$ has, of course, been adopted for the two sources to be encoded, each being placed at a given position in space.

In FIG. 8, $\tau^1_{ITD}$ and $\tau^2_{ITD}$ denote the delays (ITD) corresponding to the positions of the sources $S_1$ and $S_2$. In this example, the two sounds are supposed to reach the right ear before reaching the left ear.

In FIG. 9, the encoding gains for the position of source i and for channel $j \in [1, \ldots, n]$ are also denoted $g^i_{j,L}$. It is recalled that the gains for the left or right ear are identical, symmetry being introduced during the filtering.

For the decoding part of FIG. 8, the decoding filters for channel j are denoted $F_{j,L}$ and the filters symmetric to the filters $F_{j,L}$ are denoted $\hat{F}_{j,L}$. It is indicated here that in the case of virtual loudspeakers, the symmetric filter of a given virtual loudspeaker (a given channel) is the filter of the symmetric virtual loudspeaker (when considering the left/right symmetry plane of the head).

Finally, L and R denote the left and right binaural channels.

In the implementation of FIG. 8, as the ITD delay is introduced at the moment of encoding, the multichannel signals for the left pathway are different from those for the right pathway. The consequences of introducing delays on encoding are therefore a doubling of the number of encoding operations and a doubling of the number of channels, with respect to the second implementation illustrated in FIG. 9 and profiting from the advantages offered by the second embodiment of the invention. Thus, with reference to FIG. 8, each signal arising from a source $S_i$ in the encoding block ENCOD is split into two so that a delay (positive or negative) $\tau^1_{ITD}$, $\tau^2_{ITD}$ is applied to one of them and each signal split into two is multiplied by each gain $g^i_{j,L}$, the results of the multiplications being grouped together thereafter by channel index j (n channels) and depending on whether or not an interaural delay has been applied (2 times n channels in total). The 2 n signals obtained are conveyed through a network, are stored, or the like, with a view to reproduction and, for this purpose, are applied to a decoding block DECOD comprising n filters $F_{j,L}$ for a left pathway L and n symmetric filters $\hat{F}_{j,L}$ for a right pathway R. It is recalled that the symmetry of the filters results from the fact that a symmetry of the HRTF functions is considered. The signals to which the filters are applied are grouped into each pathway and the signal resulting from this grouping is intended to supply one of the two loudspeakers for reproduction on two remote loudspeakers (in which case it is appropriate to add an operation for canceling the cross-paths) or directly one of the two channels of a headset with earpieces for binaural reproduction.

FIG. 9 presents, for its part, an implementation of the encoding and of the multichannel decoding when the delays are, conversely, included in the decoding filters within the sense of the second embodiment using the virtual loudspeaker procedure and while exploiting the observation resulting from FIGS. 6 and 7 above.

Thus, the fact of not having to take account of the interaural delays on encoding makes it possible to reduce the number of channels to n (and no longer 2 n). The use of the symmetry of the decoding filters makes it possible furthermore, in the implementation of FIG. 9, to apply the principle of decoding filtering through a sum $(F_{j,L}+\hat{F}_{j,L})/2$ over k first channels (k being here the number of virtual loudspeakers positioned between 0 and 180° inclusive), followed by a difference $(F_{j,L}-\hat{F}_{j,L})/2$ over the following channels and therefore to halve the number of filterings required. Of course, each sum or each difference of filters must be considered to be a filter per se. What is indicated here as being a sum or a difference of filters must be considered in relation to the expressions for the filters $F_{j,L}$ and $\hat{F}_{j,L}$ described above with reference to FIG. 8.

It is indicated that this implementation of FIG. 9 would, on the other hand, be impossible if the delays had to be integrated into the encoding as illustrated in FIG. 8.

The processing on decoding of FIG. 9 continues with a grouping of the sums SS and a grouping of the differences SD supplying the pathway L through their sum (module SL delivering the signal SS+SD) and the pathway R through their difference (module DR delivering the signal SS−SD).

Thus, whereas the solution illustrated in FIG. 8 requires:

on encoding, the consideration of two delays, multiplications by 4 n gains and 2 n sums, and on decoding, 2 n filterings and 2 n sums, the solution illustrated in FIG. 9 requires only:

2 n gains and n sums on encoding, and n filterings, n sums and simply one sum and one global difference, on decoding.

Additionally, even if the memory storage requires, for the two solutions, the same capacities (storage of n filters by calculating the delays and the gains on the fly), the useful work memory (buffer) for the implementation of FIG. 8 requires more than double the useful memory of the implementation of FIG. 9, since 2 n channels travel between the encoding and the decoding and since it is necessary to employ one delay line per source in the implementation of FIG. 8.

The present invention is thus concerned with a sound spatialization system with multichannel encoding and for reproduction on two channels comprising a spatial encoding block ENCOD defined by encoding functions associated with a plurality of encoding channels and a decoding block DECOD based on applying filters for reproduction in a binaural context. In particular, the spatial encoding functions and/or the decoding filters are determined by implementing the method described above. Such a system can correspond to that illustrated in FIG. 8, in a realization for which the delays are integrated at the moment of encoding, this corresponding to the state of the art within the sense of document WO-00/19415.

Another advantageous realization consists of the implementation of the method according to the second embodiment so as thus to construct a spatialization system with a block for direct encoding, without applying delay, so as to reduce a number of encoding channels and a corresponding number of decoding filters, which directly include the interaural delays ITD, according to an advantage offered by implementing the invention, as illustrated in FIG. 9.

This realization of FIG. 9 makes it possible to attain a quality of spatial rendition that is at least as good as, if not better than, the prior art techniques, doing so with half the number of filters and a lower calculation cost. Specifically, as has been shown with reference to FIGS. 6 and 7, in the case where the decomposition is concerned with a suite of HRIR functions, this realization allows a quality of reconstruction of the modulus of the HRTFs and of the interaural delay that is better than the prior art techniques with a reduced number of channels.

The present invention is also concerned with a computer program comprising instructions for implementing the method described above and the algorithm of which may be illustrated by a general flowchart of the type represented in FIG. 1.

The invention claimed is:

1. A method of sound spatialization with a multichannel encoding and for reproduction on two loudspeakers, comprising a spatial encoding defined by encoding functions associated with a plurality of encoding channels and a decoding by applying filters for reproduction in a binaural context on the two loudspeakers, comprising:

a) obtaining an original suite of acoustic transfer functions specific to an individual's morphology, each transfer function in said original suite of acoustic transfer functions being associated with a position in space;

b) choosing, on the basis of at least one criterion of reduction of calculation complexity, to fix at least one of spatial encoding functions or decoding filters, and c) through successive iterations, optimizing the filters associated with the chosen encoding functions fixed in b) or the encoding functions associated with the chosen filters fixed in b), or jointly the chosen filters and encoding functions, by minimizing an error calculated as a function of a comparison between:

the original suite of acoustic transfer functions, and a suite of transfer functions reconstructed on the basis of the encoding functions and the decoding filters, optimized and/or chosen, wherein the comparison in c) is calculated by, for each position in space associated with a transfer function in said original suite of acoustic transfer functions:

computing a first value being a moduli of said transfer function in said original suite of acoustic transfer functions;

computing a second value being a moduli of a transfer function in the suite of reconstructed transfer functions;

computing differences between the first value and the second value, expressed in the frequency domain and time independent.

2. The method as claimed in claim 1, wherein the reconstructed suite of transfer functions is calculated by multiplying the filters by the encoding functions at each iteration.

3. The method as claimed in claim 2, wherein, in b), spatial encoding functions are chosen which represent intensity panning laws based on virtual loudspeaker positions.

4. The method as claimed in claim 3, wherein the positions of the virtual loudspeakers correspond to positions of a multichannel reproduction system with "surround" effect, the optimized decoding filters allowing a decoding of multichannel multimedia contents with "surround" effect for reproduction on two loudspeakers.

5. The method as claimed in claim 3, wherein the encoding functions comprise a plurality of zero gains to be associated with encoding channels.

6. The method as claimed in claim 2, wherein, in b), spatial encoding functions of the spherical harmonic type in an ambiophonic context are chosen.

7. The method as claimed in claim 1, wherein interaural delay information is extracted, on the basis of the transfer functions obtained in a), while the optimization of the encoding functions and/or of the decoding filters is conducted on the basis of transfer functions from which said delay information has been extracted, said delay information being applied subsequently, on encoding.

8. The method as claimed in claim 1, wherein interaural delay information is taken into account in the optimization of the decoding filters, and the spatial encoding is conducted without delay application.

9. The method as claimed in claim 1, wherein, in b), some of the transfer functions obtained are chosen as decoding filters.

10. The method as claimed in claim 1, wherein, for the first optimization iteration, the decoding filters are calculated by a solution of the pseudo-inverse type.

11. The method as claimed in claim 1, wherein each difference is weighted as a function of a given direction in space so as to favor certain of said directions.

12. A sound spatialization system transforming a sound signal with a multichannel encoding and for reproduction on two loudspeakers, comprising a spatial encoding block defined by encoding functions associated with a plurality of encoding channels and a block for decoding by applying filters for reproduction in a binaural context on two loudspeakers, wherein the spatial encoding functions and/or the decoding filters are determined by implementing the method as claimed in claim 1.

13. A computer program product comprising a non-transitory computer readable medium, having stored thereon a computer program comprising program instructions, the computer program being loadable into a data-processing unit and adapted to cause the data-processing unit to carry out the steps of claim 1 when the computer program is run by the data-processing unit.

* * * * *

UNITED STATES PATENT AND TRADEMARK OFFICE

CERTIFICATE OF CORRECTION

PATENT NO. : 9,215,544 B2
APPLICATION NO. : 12/224840
DATED : December 15, 2015
INVENTOR(S) : Faure et al.

It is certified that error appears in the above-identified patent and that said Letters Patent is hereby corrected as shown below:

In the Specification

In column 2 at line 37 (approx.), Change

„$R\ (\theta_p, \varphi_p, f) = T_R(\theta_p, \varphi_p)\ \underline{L}\ (\theta_p, \varphi_p, f)\ for\ p = 1,2,\ldots,P$„ to -- $R\ (\theta_p, \varphi_p, f) = T_R(\theta_p, \varphi_p)\ \underline{R}\ (\theta_p, \varphi_p, f)\ for\ p = 1,2,\ldots,P$ --.

In column 5 at line 33, Change "$g(\theta_p, \varphi_p, n)$" to -- $g(\theta, \varphi, n)$ --.

In column 5 at line 44, Change "HRTFS" to -- HRTFs --.

Signed and Sealed this
Twenty-eighth Day of June, 2016

Michelle K. Lee

Michelle K. Lee
*Director of the United States Patent and Trademark Office*